US008708172B2

(12) United States Patent
Kim et al.

(10) Patent No.: US 8,708,172 B2
(45) Date of Patent: Apr. 29, 2014

(54) MULTI-STAGE TROLLEY FOR A CRANE AND A CRANE THEREWITH

(75) Inventors: Kyung-Soo Kim, Daejeon (KR); Hanjong Ju, Daejeon (KR); Soo Hyun Kim, Daejeon (KR); In Gwun Jang, Daejeon (KR); Yunsub Jung, Daejeon (KR); Eun Ho Kim, Daejeon (KR); Youn Sik Park, Daejeon (KR); Byung Man Kwak, Daejeon (KR)

(73) Assignee: Korea Advanced Institute of Science and Technology (KR)

( * ) Notice: Subject to any disclaimer, the term of this patent is extended or adjusted under 35 U.S.C. 154(b) by 525 days.

(21) Appl. No.: 12/969,775

(22) Filed: Dec. 16, 2010

(65) Prior Publication Data

US 2011/0247991 A1 Oct. 13, 2011

(30) Foreign Application Priority Data

Apr. 8, 2010 (KR) ..... 10-2010-0032270

(51) Int. Cl.
*B66C 19/00* (2006.01)

(52) U.S. Cl.
USPC ..... 212/328; 212/87

(58) Field of Classification Search
USPC ..... 212/87, 83, 76, 77, 88, 90, 91, 94, 97, 212/98, 117, 119, 120, 328
See application file for complete search history.

(56) References Cited

U.S. PATENT DOCUMENTS 3,081,884 A * 3/1963 Minty ..... 212/274
3,207,329 A * 9/1965 Bevard ..... 414/143.2
3,536,351 A * 10/1970 Zweifel et al. ..... 294/81.1
3,567,040 A * 3/1971 Thomson ..... 212/242
3,671,069 A * 6/1972 Martin et al. ..... 294/81.1
3,779,395 A * 12/1973 Dykeman ..... 212/81
3,874,516 A * 4/1975 Watanabe ..... 212/87
3,887,080 A * 6/1975 Wilson ..... 212/318
3,899,083 A * 8/1975 Flessner et al. ..... 212/274
3,944,272 A * 3/1976 Fathauer ..... 294/81.21

(Continued)

FOREIGN PATENT DOCUMENTS

JP 54-47264 * 4/1979 ..... B66C 19/00
KR 10-1998-0085896 12/1998

(Continued)

OTHER PUBLICATIONS

The PCT Search Report dated Aug. 4, 2011 and Written Opinion.

(Continued)

*Primary Examiner* — Emmanuel M Marcelo
*Assistant Examiner* — Justin Stefanon
(74) *Attorney, Agent, or Firm* — Bacon & Thomas, PLLC

(57) ABSTRACT

A crane for loading and unloading a cargo includes multi-stage trolley. The multi-stage trolley for a crane includes a first trolley movable in a longitudinal direction along a boom of the crane; a second trolley movable in a lateral direction on the first trolley; a hoisting wire provided in the longitudinal direction along the boom; a spreader connected to the hoisting wire through the first trolley and the second trolley and supported by the hoisting wire, the spreader being movable in a vertical direction according to a movement of the hoisting wire. The multi-stage trolley further includes a sheave block unit for changing a direction of the hoisting wire to maintain a vertical level of the spreader constant when the first trolley and/or the second trolley is moved.

20 Claims, 11 Drawing Sheets

(56) References Cited

U.S. PATENT DOCUMENTS

| | | | | | |
|---|---|---|---|---|---|
| 3,945,503 | A | * | 3/1976 | Cooper | 212/274 |
| 4,168,857 | A | * | 9/1979 | Kloos | 294/81.4 |
| 4,350,254 | A | * | 9/1982 | Noly | 212/279 |
| 5,186,342 | A | * | 2/1993 | Shimizu | 212/274 |
| 5,538,382 | A | * | 7/1996 | Hasegawa et al. | 414/141.7 |
| 5,909,817 | A | * | 6/1999 | Wallace et al. | 212/275 |
| 6,145,680 | A | * | 11/2000 | Jussila et al. | 212/274 |
| 6,196,402 | B1 | * | 3/2001 | Staats | 212/91 |
| 6,250,486 | B1 | * | 6/2001 | Enoki | 212/322 |
| 6,382,437 | B1 | * | 5/2002 | Okada et al. | 212/274 |
| 6,644,486 | B2 | * | 11/2003 | Jacoff et al. | 212/274 |
| 2008/0213073 | A1 | | 9/2008 | Benedict et al. | |

FOREIGN PATENT DOCUMENTS

| | | |
|---|---|---|
| KR | 10-2000-0000529 | 1/2000 |
| KR | 10-2001-0057394 | 7/2001 |
| KR | 10-0649728 | 11/2006 |
| WO | 2011/034260 | 3/2011 |
| WO | 2011/043516 | 4/2011 |
| WO | 2011/049268 | 4/2011 |

OTHER PUBLICATIONS

The extended European Search Report dated Aug. 16, 2011.

* cited by examiner

MULTI-STAGE TROLLEY FOR A CRANE AND A CRANE THEREWITH

FIELD OF THE INVENTION

The present invention relates to a trolley and a crane for loading and unloading a cargo.

BACKGROUND OF THE INVENTION

A marine transportation using ships as a goods movement means to a remote area consumes less energy compared with other transportation and incurs a low transportation cost, so it takes a large portion of global trade.

Recently, a marine transportation such as a container carrier uses a large ship in order to improve the efficiency of transportation, and the use of the large ship increases the volume of traffic of ships to secure economic efficiency of transportation. Thus, more harbors having mooring facilities for allowing a large ship to come alongside the pier and loading and unloading facilities are increasingly required.

However, harbors allowing a large container ship to come alongside the pier are limited around the world, and construction of such a harbor incurs much cost due to dredging or the like for maintaining the depth of water in the harbor and requires a spacious area. In addition, the construction of a big harbor causes traffic congestion nearby or greatly affects the surrounding environment such as damage to a coastal environment, leaving a variety of restrictions to the construction of a big harbor.

Thus, research into a mobile harbor allowing a large ship to anchor in the sea away from the land and ship and load cargo, rather than making a large ship to come alongside the pier in the harbor, is under way.

FIG. 1 is a schematic view showing that a container C handling operation with respect so a container carrier S is performed by a crane 1 installed in a ship 50 serving as a mobile harbor. Here, a widthwise direction of a boom 10 (or a lengthwise direction of the ship 50) is defined as a lateral direction (X direction in the figure), and a lengthwise direction of the boom 10 (or a widthwise direction of the ship 50) is defined as a longitudinal direction (Y direction in the figure).

In general, the crane 10 comprises a spreader 30 gripping a container C and moved in the vertical direction, a trolley 20 supporting the spreader 30 and moved in the longitudinal direction and the boom 10 guiding the trolley 20 to enable she trolley to be moved.

FIG. 2 is a view showing schematically a method for tying a hoist wire of a conventional crane. A spreader is moved in the vertical direction by using a hoist wire system provided on a boom B. The hoist wire system includes a wire drum B1 winding/unwinding a hoist wire W and a various kinds of sheave blocks B2, B3, T1 and S1 for changing a direction of the hoist wire W. A spreader is coupled to the sheave block S1. The hoist wire W is tied such that a vertical level of the spreader is not changed even though a trolley 1 is moved.

In the meantime, a pitching and a roiling of the ship on the sea are indispensably occurred due to a wind, wave or tidal current, and the like. Referring to FIG. 1, in the conventional crane 1, the trolley 20 moved on the crane boom 10 and the spreader 30 mounted to the trolley can be moved only the longitudinal direction. Accordingly, when a relative location between the crane 1 or the ship 50 and the container ship S is not maintained due to a pitching and rolling of the ship, it is difficult to couple or decouple the spreader 30 with or from the container. To correct the above defect, the crane 1 itself or the ship 50 itself should be moved, so that it is not easy to control the crane or the ship and power is excessively consumed.

SUMMARY OF THE INVENTION

The present invention provides a multi-stage trolley for a crane in which a spreader can be moved in the lateral direction as well as the longitudinal direction, and a vertical level of the spreader can be maintained constant in spite of the above movement.

In accordance with an aspect of the present invention, there is provided a multi-stage trolley for a crane, comprising: a first trolley movable in a longitudinal direction along a boom of the crane; a second trolley movable in a lateral direction on the first trolley; a hoisting wire provided in the longitudinal direction along the boom; a spreader connected to the hoisting wire through the first trolley and the second trolley and supported by the hoisting wire, the spreader being movable in a vertical direction according to a movement of the hoisting wire; and a sheave block unit for changing a direction of the hoisting wire to maintain a vertical level of the spreader constant when the first trolley and/or the second trolley is moved.

In accordance with another aspect of the present invention, there is provided a crane including the multi-stage trolley.

BRIEF DESCRIPTION OF THE DRAWINGS

The objects and features of the present invention will become apparent from the following description of embodiments given in conjunction with the accompanying drawings, in which.

DETAILED DESCRIPTION OF THE EMBODIMENTS

Figure 1:
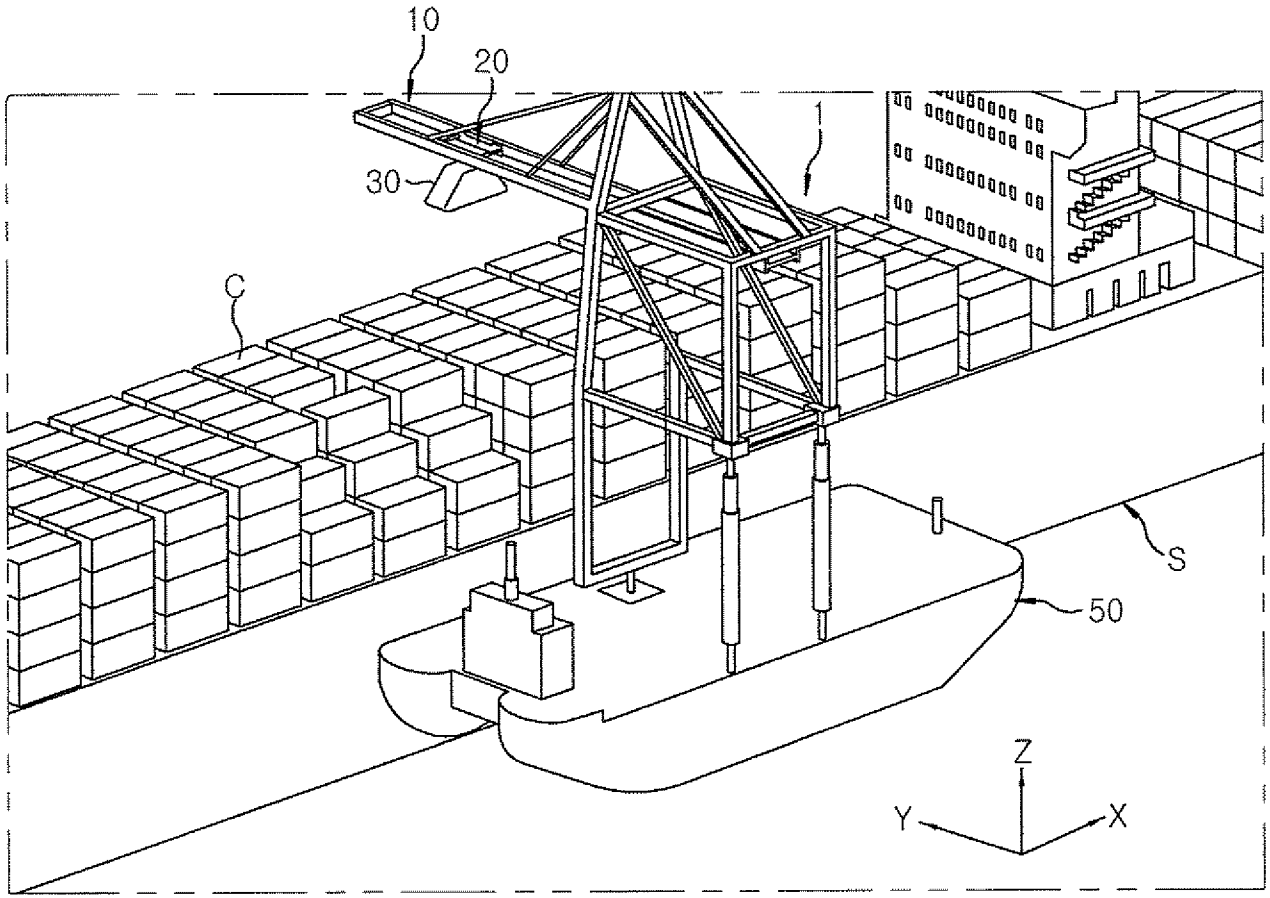
FIG. 1 (PRIOR ART)
FIG. 1 is a schematic view showing that a cargo handling operation with respect to a container carrier is performed by a crane installed in a ship.
Figure 2:
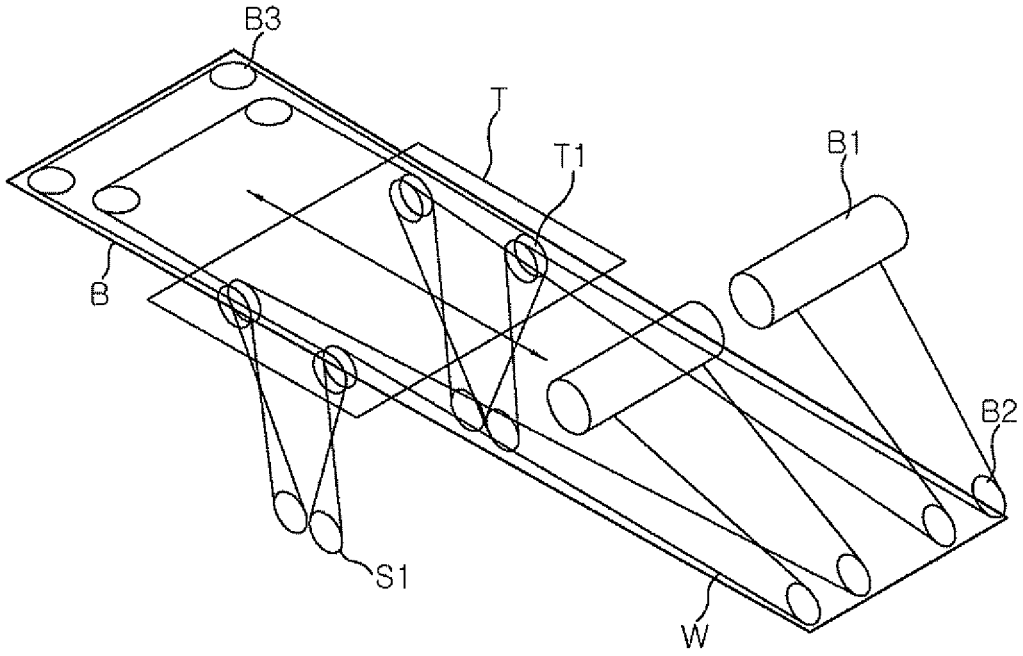
FIG. 2 (PRIOR ART)
FIG. 2 is a view showing schematically a method for tying a hoist wire of a conventional crane.

Hereinafter, embodiments of the present invention will be described in detail with reference to the accompanying drawings. Same reference numeral is given to the same or corresponding element, and a duplicated explanation thereon will be omitted.

A multi-stage trolley for a crane according to one embodiment of the present invention is illustrated with reference to FIG. 3 to FIG. 5

Figure 3:
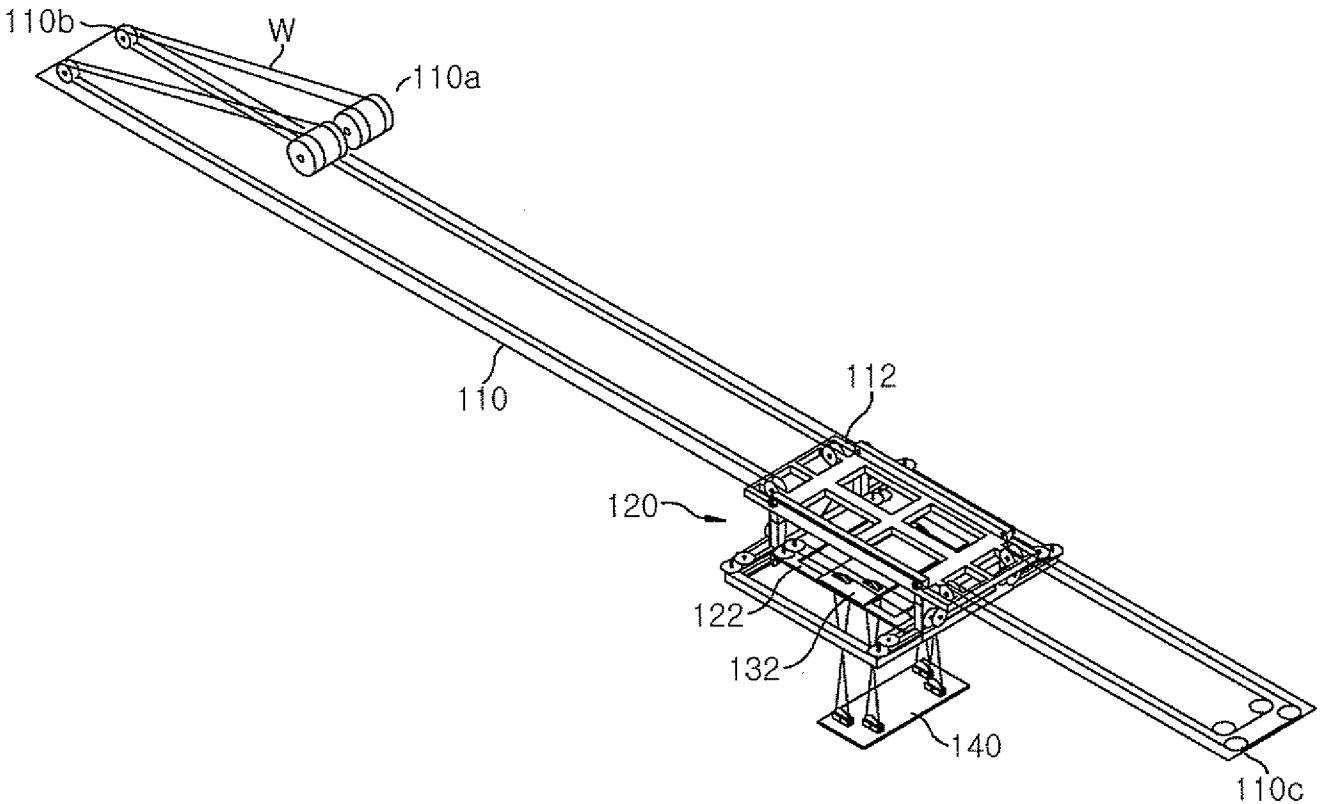
FIG. 3 is a view showing schematically a multi-stage trolley and a hoisting wire system employed in a crane according to one embodiment of the present invention.
Figure 4:
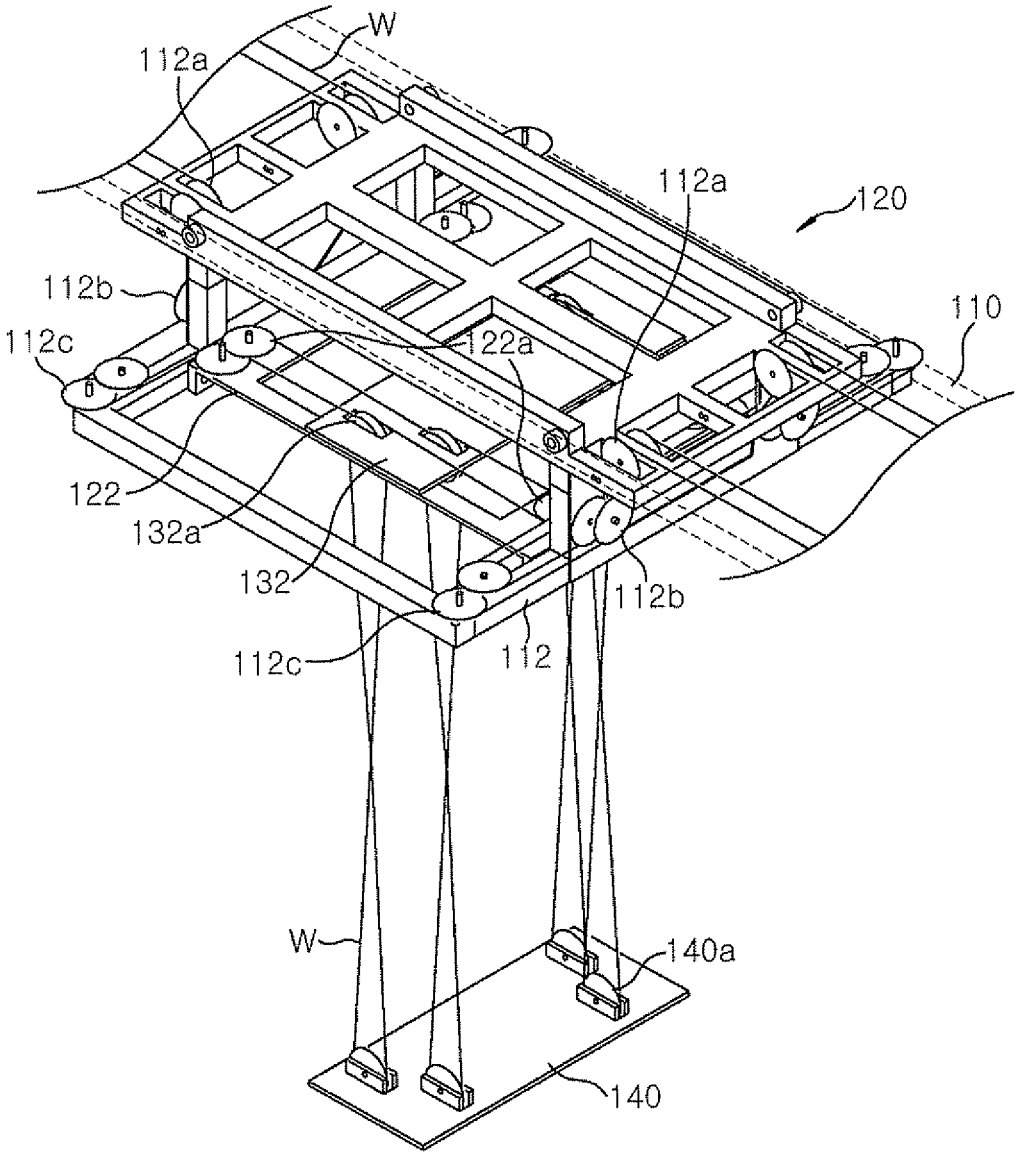
FIG. 4 is a view showing schematically a structure of the multi-stage trolley according to one embodiment of the present invention.
Figure 5:
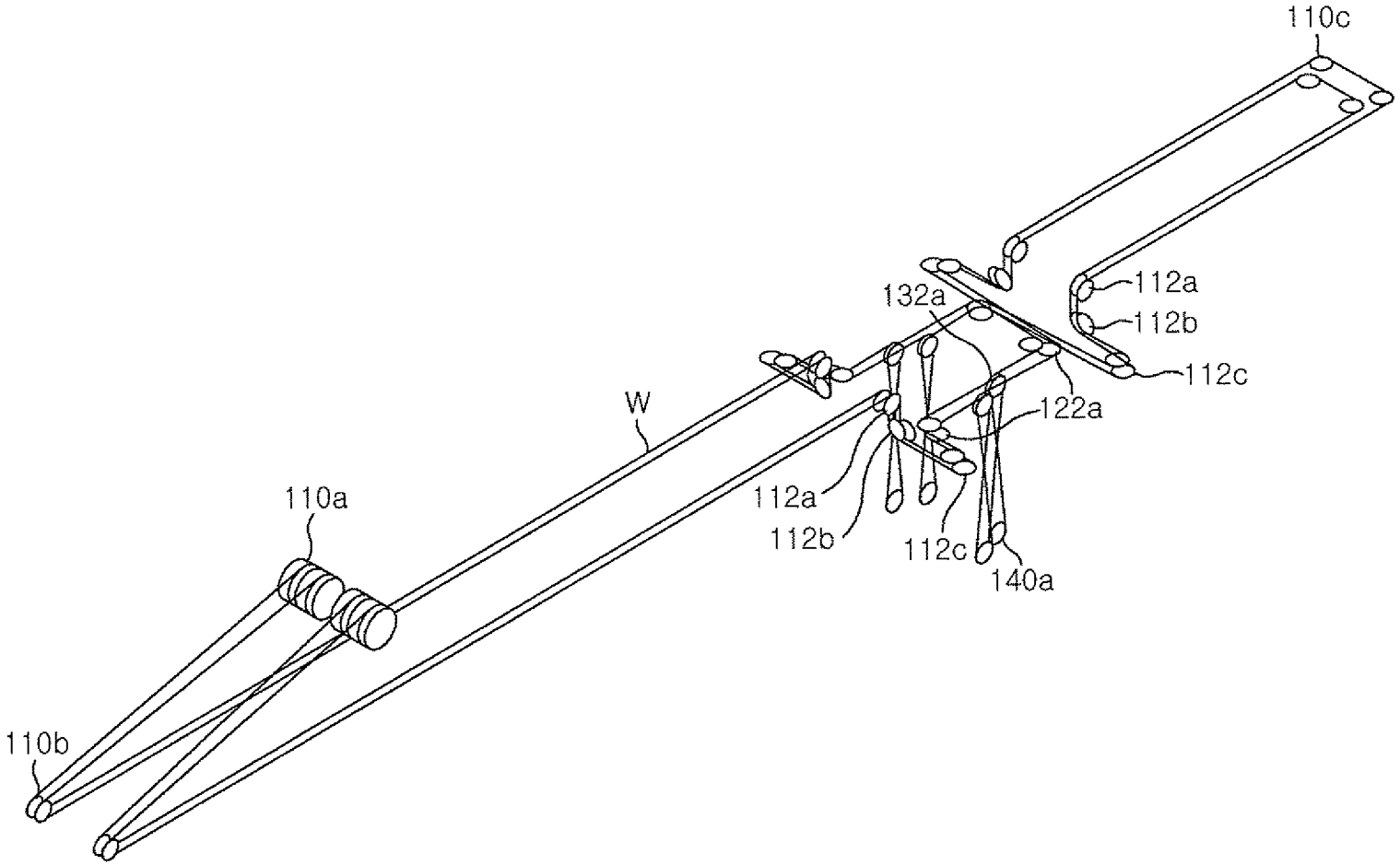
FIG. 5 is a view showing schematically structure of the hoisting wire system with a sheave block unit according to one embodiment of the present invention.

FIG. 3 is a view showing schematically a multi-stage trolley and a hoisting wire system employed in a crane according to one embodiment of the present invention, FIG. 4 is a view showing schematically a structure of the multi-stage trolley according to one embodiment of the present invention, and FIG. 5 is a view showing schematically structure of the hoisting wire system with a sheave block unit according to one embodiment of the present invention.

The crane according to one embodiment of the present invention is provided with a hoisting wire system which have a multi-stage trolley structure by which a spreader can be moved in the lateral and/or the longitudinal directions and vertical level of the spreader can be maintained regardless of the above movement.

The multi-stage trolley comprises a first trolley 112, a second trolley 122, a third trolley 132, a spreader 140, a hoisting wire W, a wire driving drum 110*a* and a sheave block unit.

A structure and function of a multi-stage trolley is illustrated with reference to FIG. 3 and FIG. 4

The first trolley 112 may be moved in the longitudinal direction along a boom 110. The second trolley 122 may be moved on the first trolley 112 in the lateral direction. The third trolley 132 may be moved on the second trolley 122 in the longitudinal direction. By moving the first, second and third trolleys 112, 122, 132 in the both direction through the multi-stage structure, the spreader 140 can be also moved in both directions.

Although a longitudinal location of a cargo such as a container to be unloaded is changed, e.g., by a pitching and rolling of the ship, it is possible to operate rapidly and economically the crane by moving the second trolley 122, without need to move the crane or the ship to which the crane is installed.

In order to move the spreader 140 in the lateral direction for transporting the container, the first trolley 112 is utilized, and the third trolley 132 can be moved in the lateral direction to correct a change of location caused by a pitching/rolling of the ship of the ship. Therefore, it is possible to operate rapidly and economically the spreader 140.

A structure and function of the hoisting wire system are described with reference to FIG. 3 and FIG. 5.

The spreader 140 is connected to the hoisting wire W through the first, second and third trolleys 112, 122 and 132 and then supported by the hoisting wire W. The spreader 140 can be moved in the vertical direction according to a movement of the hosting wire W.

The hosting wires W are provided at both lateral end portions of the boom 110 and arranged in the longitudinal direction so that the hoisting wire may be connected to spreader 140. The hosting wire W is passed through boom end sheave blocks 110*b* and 110*c* and extended from the wire driving drum 110*a* to the spreader 140 through the first, second and third trolleys 112, 122 and 132.

The wire driving drum 110*a* winds or unwinds the hoisting wire W to adjust a vertical level of the spreader 140. A vertical movement of the spreader 140 is independently controlled by the wire driving drum 110*a* regardless of a movement of the trolley.

The sheave blocks change a direction of the hoisting wire to allow a vertical level of the spreader 140 to be kept unchanged when the second trolley 122 is moved in the lateral direction. Also, the sheave blocks can compel the level of the spreader 140 to be unchanged when the third trolley 132 is moved in the longitudinal direction.

A connection relation among the sheave blocks, the multi-stage trolley and the hoisting wire is illustrated in more detail with reference to FIG. 4 and FIG. 5

The sheave block unit may include direction changing sheave blocks 112*a* and 112*b*, direction reversing sheave blocks 112*c*, direction restoring sheave blocks 122*a*, spreader sheave blocks 132*a* and 140*a*.

Direction changing sheave blocks 112*a* and 112*b* change direction of the hoisting wire W provided in the longitudinal direction into the lateral direction. 2 or 4 pairs of direction changing sheave blocks 112*a* and 112*b* may be provided at longitudinal ends of the first trolley 112. Pairs of direction changing sheave blocks 112*a* and 112*b* diagonally disposed are coupled to each other by the hoisting wire.

Direction reversing sheave blocks 112*c* change direction of the hoisting wire W by 180 degree, which is provided to the first trolley 112 in the lateral direction, by bending the hoisting wire into a U shape to connect the hoisting wire to the second trolley 122. 2 or 4 pairs of direction reversing sheave blocks 112*c* may be provided at lateral and longitudinal ends of the first trolley 112. Pairs of direction reversing sheave blocks 112*c* diagonally disposed are coupled to each other by the hoisting wire.

Direction restoring sheave blocks 122*a* change direction of the hoisting wire W, which is provided to the second trolley 122 in the lateral direction, into the longitudinal direction to connect the hoisting wire to the third trolley 132. 2 or 4 pairs of direction restoring sheave blocks 122*a* may be provided. Pairs of direction restoring sheave blocks 122*a* diagonally disposed are coupled to each other by the hoisting wire.

Spreader sheave blocks 132*a* change direction of the hoisting wire W, which is provided to the third trolley 132 in the longitudinal direction, into the vertical direction to connect the hoisting wire to spreader sheave blocks 140*a* provided on the spreader 140. 1 or 2 pairs of) third trolley sheave blocks 132*a* may be provided. The sheave blocks 112*a*, 112*h*, 112*c*, 122*a* located on the diagonal position are connected each other through the hoisting wire W via the spreader sheave blocks 140*a*.

The third trolley 132 may not be provided in another embodiment of the present invention. Although the above structure in which the third trolley is not provided is not shown in the drawings, instead of the third trolley sheave blocks 132*a*, direction of the hoisting wire W may be changed into the vertical direction by sheave blocks provided on the second trolley 122, and so the hoisting wire can be connected to the spreader 140.

Below, an operating method of the multi-stage trolley and the crane according to one embodiment of the present invention is illustrated with reference to FIG. 6 to FIG. 11.

Figure 6:
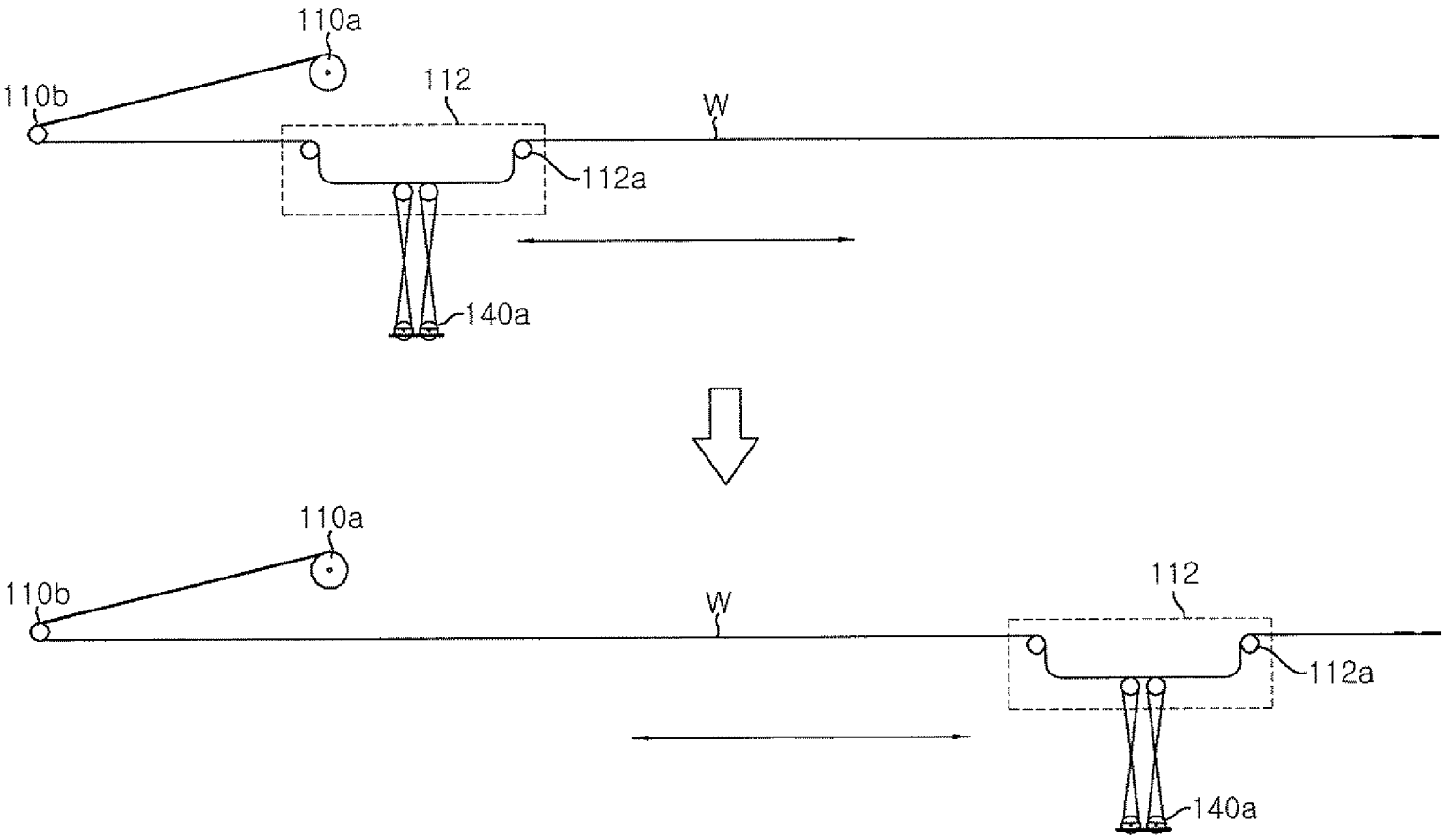
FIG. 6 is a view showing a shape of the multi-stage trolley in a case where a first trolley is moved along a boom.

FIG. 6 is a view showing a shape of the multi-stage trolley in a case where the first trolley is moved along the boom;

Even if the first trolley 112 is moved along the boom 110, since a length of the hoisting wire W in the first trolley 112 is not changed, a vertical location of the spreader 140 is constantly maintained while the first trolley 112 is moved.

Figure 7:
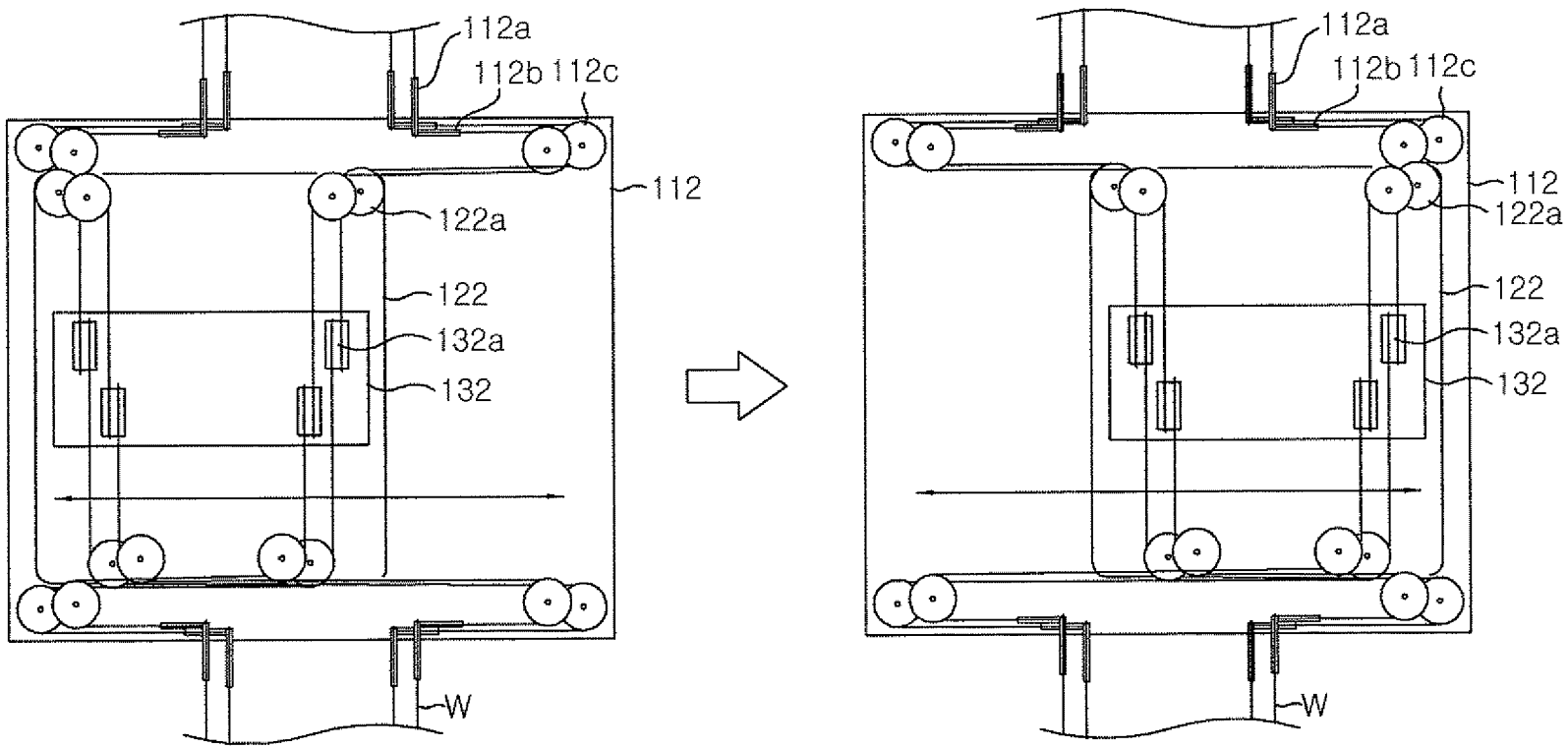
FIG. 7 is a view showing a shape of the multi-stage trolley in a case where a second trolley is moved.
Figure 8:
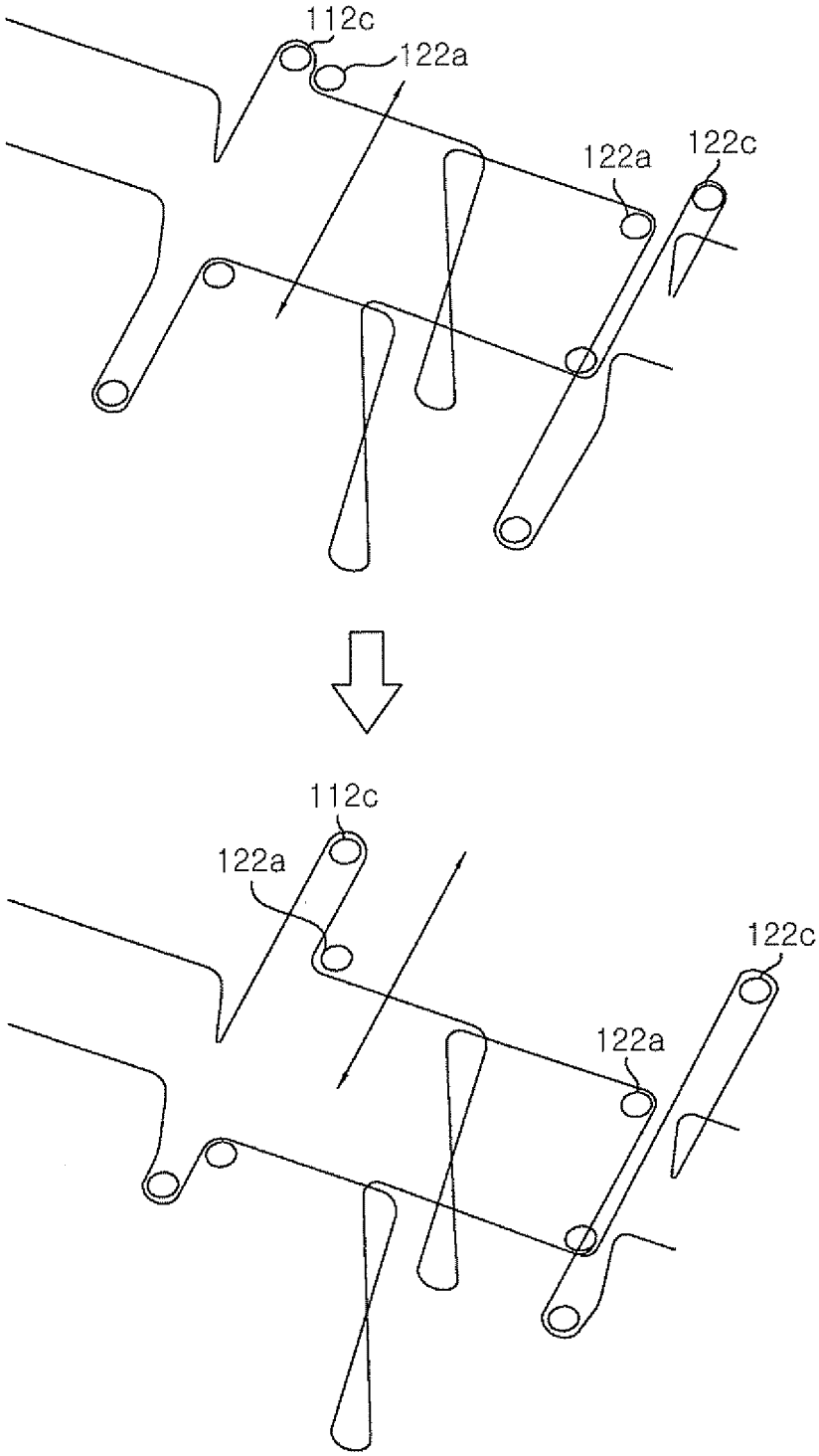
FIG. 8 is a view showing a shape of the hoisting wire in a case where the second trolley is moved.

FIG. 7 is a view showing a shape of the multi-stage trolley in a case where the second trolley is moved, and FIG. 8 is a view showing a shape of the hoisting wire in a case where the second trolley is moved.

Since the direction reversing sheave blocks 112*c* located on the diagonal position are connected each other through the hoisting wire W, even if the second trolley 122 is moved, the hoisting wire W out of the first trolley sheave blocks 112*c* is fixed. The second trolley 122 is moved in the longitudinal direction and a height of the spreader 140 is constantly maintained without a change of the length of the hoisting wire W in the second trolley sheave blocks 122*a*.

Figure 9:
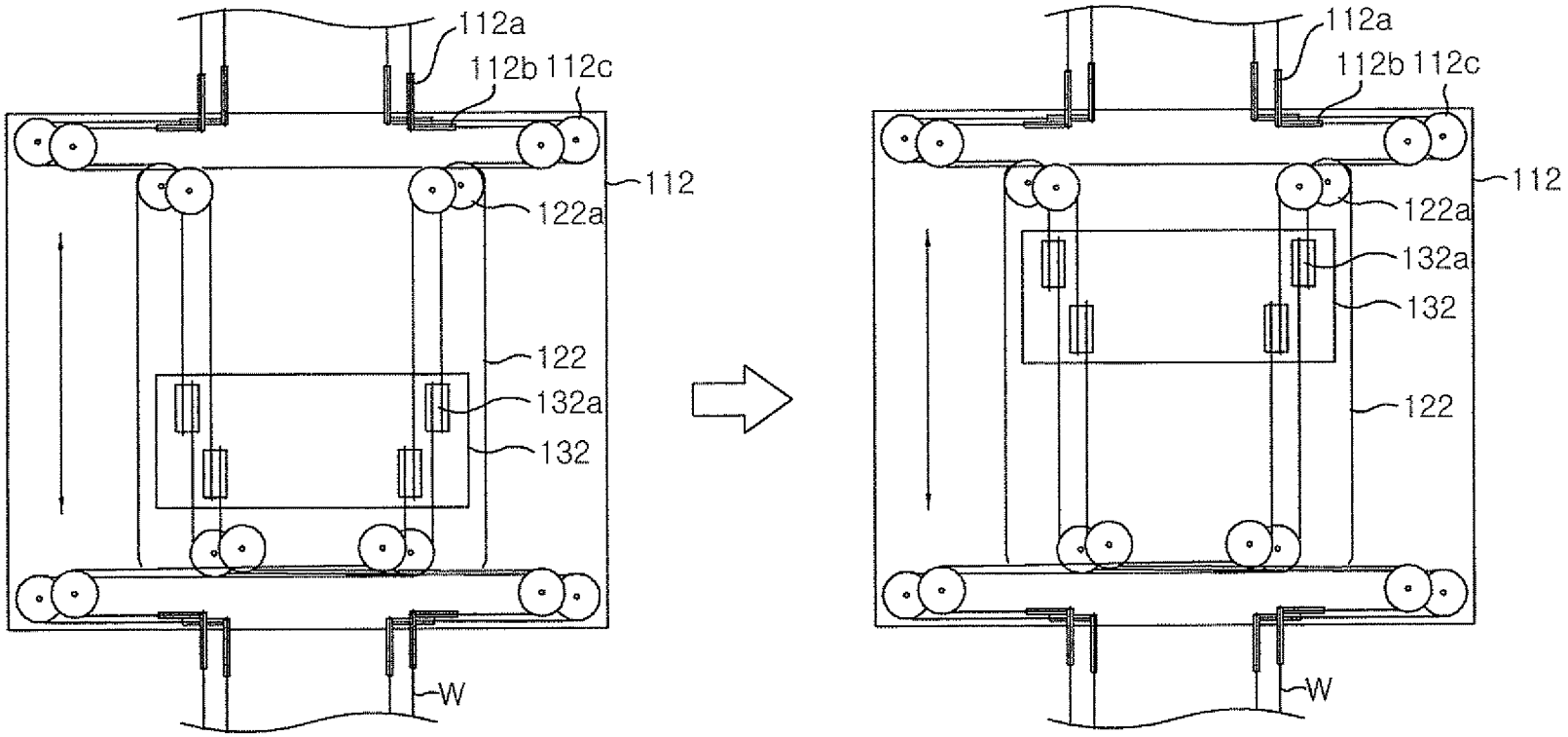
FIG. 9 is a view showing a shape of the multi-stage in a case where a third trolley is moved.
Figure 10:
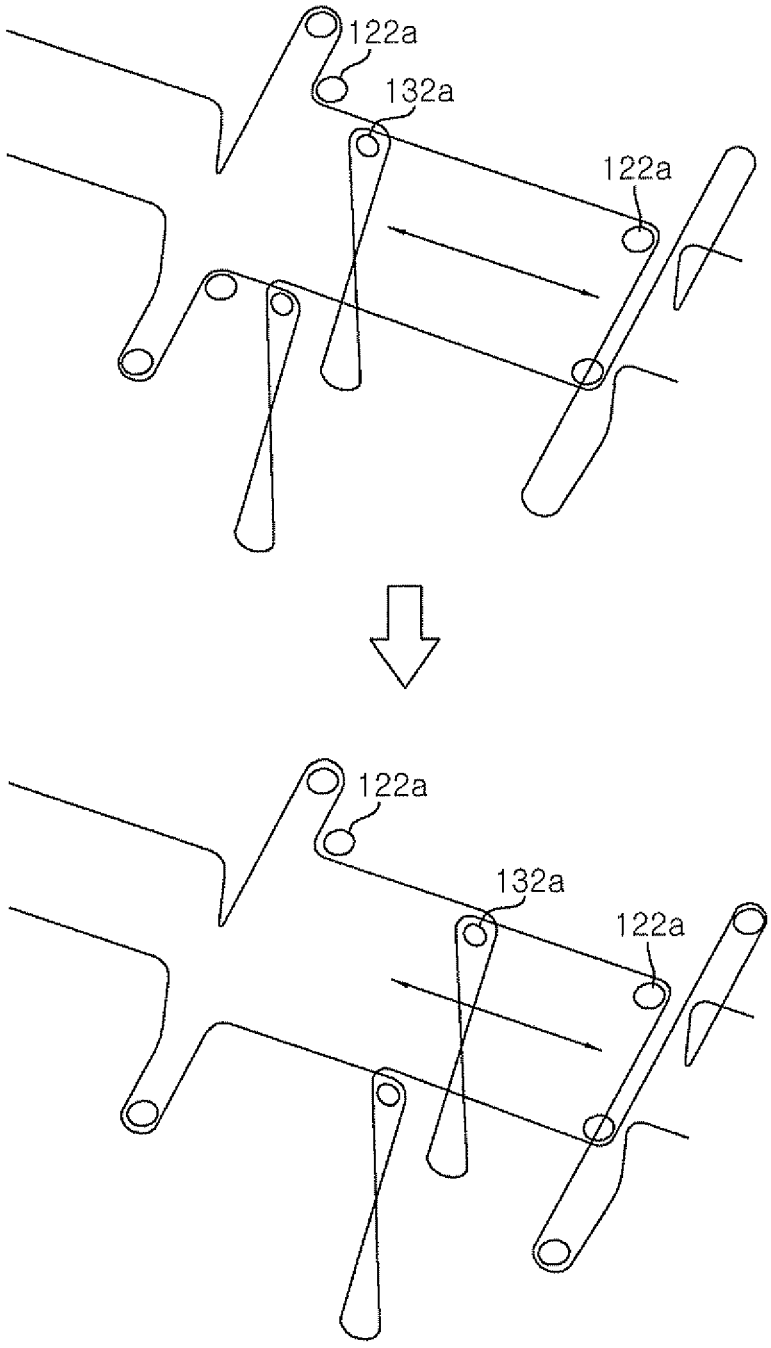
FIG. 10 is a view showing a shape of the hoisting wire in a case where the third trolley is moved.

FIG. 9 is a view showing a shape of the multi-stage in a case where the third trolley is moved, and FIG. 10 is a view showing a shape of the hoisting wire in a case where the third trolley is moved.

Although the third trolley 132 is moved, the hoisting wire W out of the second trolley sheave blocks 122*a* is fixed. The third trolley 132 is moved in the lateral direction and a height of the spreader 140 is constantly maintained without a change of the length of the hoisting wire W in the third trolley sheave blocks 132*a*.

Figure 11:
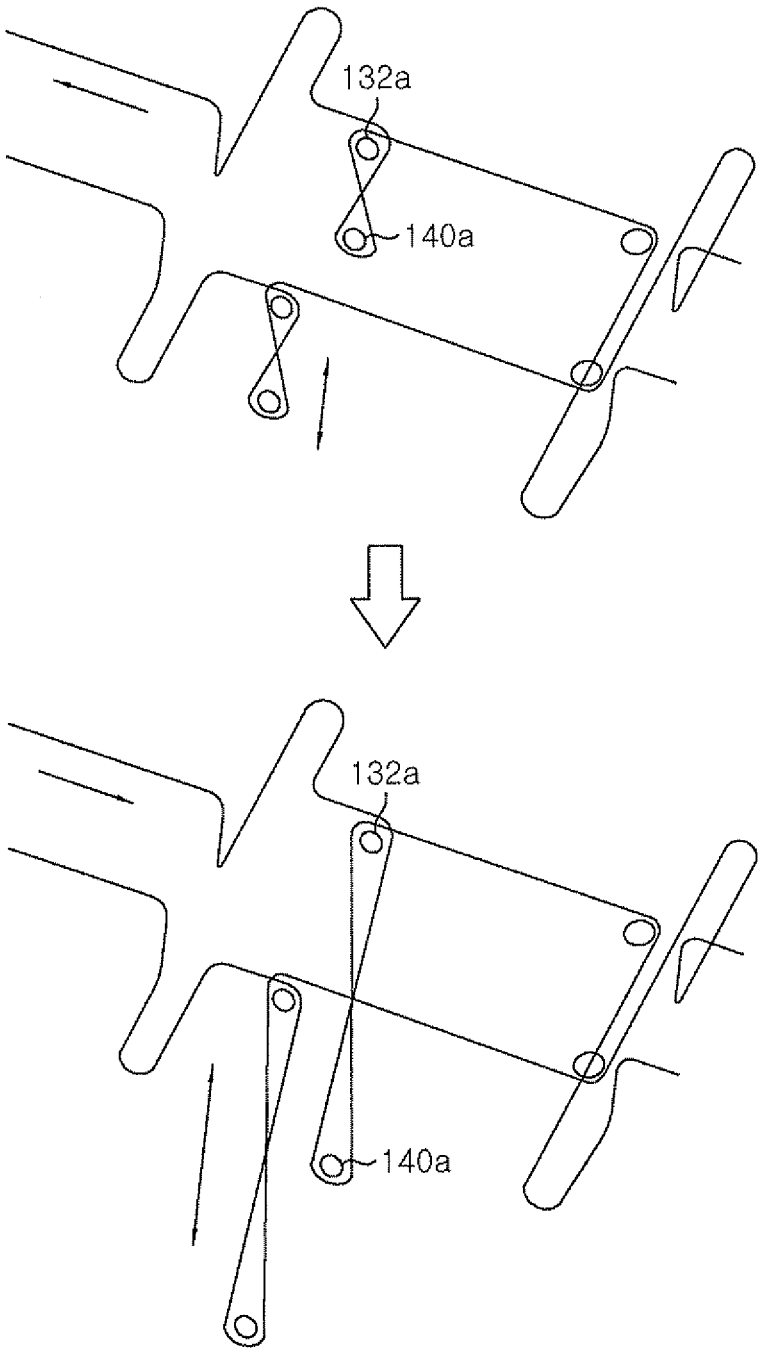
FIG. 11 is a view showing a shape of the hoisting wire in a case where a spreader is moved.

FIG. 11 is a view showing a shape of the hoisting wire in a case where the spreader is moved.

The hoisting wire W is wound or unwound by the wire driving drum 110*a*, and the spreader 140 is moved upward and downward according a winding or unwinding of the hoisting wire W.

The crane with a multi-stage trolley according to one embodiment of the present invention may be provided on a floating body floated on the sea.

The floating body may be a ship which is equipped with a self-power generating means and can be sailed, or a floating construction to be moored on the sea. The floating body can act as a mobile harbor which is floated on the sea and transfers a container between the container ships instead of a harbor of the land or together with a harbor of the land and stores temporarily the containers.

The mobile harbor, may include a platform having a space in which the container is loaded, a location determining device for acquiring information regarding the location of the platform, a mooring device for maintaining a connected state without colliding with the container carrier while a container is loaded or unloaded, and a balancing device for adjusting the platform such that the platform can be maintained in a vertical location correspondingly to a change in the weight based on the loading and unloading of the container.

According to the embodiment of the present invention, the spreader is moved in the longitudinal direction as well as the lateral direction on the trolley having the multi-stage trolley structure, and a vertical level of the spreader can be maintained or easily controlled.

While the invention has been shown and described with respect to the preferred embodiments, it will be understood by those skilled in the art that various changes and modifications may be made without departing from the scope of the invention as defined in the following claims.

What is claimed is:

1. A multi-stage trolley for a crane, comprising:

a first trolley movable in a longitudinal direction along a boom of the crane;

a second trolley movable in a lateral direction perpendicular to the longitudinal direction on the first trolley;

a hoisting wire provided in the longitudinal direction along the boom;

a spreader connected to the hoisting wire through the first trolley and the second trolley and supported by the hoisting wire, the spreader being movable in a vertical direction according to a movement of the hoisting wire;

a wire driving drum for winding or unwinding the hoisting wire to adjust a vertical level of the spreader; and a sheave block unit for changing a direction of the hoisting wire to maintain the vertical level of the spreader constant without operating the wire driving drum when the first trolley and the second trolley are moved, wherein the sheave block unit includes direction changing sheave blocks provided at the first trolley, at least one of the direction changing sheave blocks changing a direction of the hoisting wire provided thereto in the longitudinal direction into the lateral direction, wherein the direction changing sheave blocks include pairs of direction changing sheave blocks diagonally disposed at the first trolley, and at least one pair of the direction changing sheave blocks are coupled to each other by the hoisting wire.

2. The multi-stage trolley of claim 1, further comprising a third trolley movable in the longitudinal direction on the second trolley, wherein the sheave block unit maintains constant the vertical level of the spreader when the third trolley is moved and the hoisting wire connects the wire driving drum to the spreader through all of the first trolley, the second trolley and the third trolley.

3. The multi-stage trolley claim 2, wherein the sheave block unit includes direction restoring sheave blocks provided on the second trolley, at least one of the direction restoring sheave blocks changing a direction of the hoisting wire provided thereto in the lateral direction into the longitudinal direction to connect the hoisting wire to the third trolley.

4. A crane comprising a multi-stage trolley of claim 3.

5. A crane comprising a multi-stage trolley of claim 2.

6. A crane comprising a multi-stage trolley of claim 1.

7. A multi-stage trolley for a crane, comprising:

a first trolley movable in a longitudinal direction along a boom of the crane;

a second trolley movable in a lateral direction perpendicular to the longitudinal direction on the first trolley;

a hoisting wire provided in the longitudinal direction along the boom;

a spreader connected to the hoisting wire through the first trolley and the second trolley and supported by the hoisting wire, the spreader being movable in a vertical direction according to a movement of the hoisting wire;

a wire driving drum for winding or unwinding the hoisting wire to adjust a vertical level of the spreader; and a sheave block unit for changing a direction of the hoisting wire to maintain the vertical level of the spreader constant without operating the wire driving drum when the first trolley and the second trolley are moved, wherein the sheave block unit includes direction changing sheave blocks provided at the first trolley, at least one of the direction changing sheave blocks changing a direction of the hoisting wire provided thereto in the longitudinal direction into the lateral direction, and wherein at least one of the direction changing sheave blocks changes the direction of the hoisting wire provided thereto in the longitudinal direction into the vertical direction and then into the lateral direction.

8. The multi-stage trolley of claim 7, further comprising a third trolley movable in the longitudinal direction on the second trolley, wherein the sheave block unit maintains constant the vertical level of the spreader when the third trolley is moved and the hoisting wire connects the wire driving drum to the spreader through all of the first trolley, the second trolley and the third trolley.

9. The multi-stage trolley claim 8, wherein the sheave block unit includes direction restoring sheave blocks provided on the second trolley, at least one of the direction restoring sheave blocks changing a direction of the hoisting wire provided thereto in the lateral direction into the longitudinal direction to connect the hoisting wire to the third trolley.

10. A crane comprising a multi-stage trolley of claim 9.

11. A crane comprising a multi-stage trolley of claim 8.

12. A crane comprising a multi-stage trolley of claim 7.

13. A multi-stage trolley for a crane, comprising:

a first trolley movable in a longitudinal direction along a boom of the crane;

a second trolley movable in a lateral direction perpendicular to the longitudinal direction on the first trolley;

a hoisting wire provided in the longitudinal direction along the boom;

a spreader connected to the hoisting wire through the first trolley and the second trolley and supported by the hoisting wire, the spreader being movable in a vertical direction according to a movement of the hoisting wire;

a wire driving drum for winding or unwinding the hoisting wire to adjust a vertical level of the spreader; and a sheave block unit for changing a direction of the hoisting wire to maintain the vertical level of the spreader constant without operating the wire driving drum when the first trolley and the second trolley are moved, the sheave block unit includes direction reversing sheave blocks provided at the first trolley, at least one of the direction reversing sheave blocks changing a direction of the hoisting wire provided thereto in the lateral direction by 180 degree to connect the hoisting wire to the second trolley.

14. The multi-stage trolley of claim 13, wherein the direction reversing sheave blocks include pairs of direction reversing sheave blocks diagonally disposed at the first trolley, and at least one pair of the direction reversing sheave blocks are coupled to each other by the hoisting wire.

15. The multi-stage trolley of claim 14, wherein the pairs of the direction reversing sheave blocks are disposed at lateral ends of the first trolley.

16. The multi-stage trolley of claim 13, further comprising a third trolley movable in the longitudinal direction on the second trolley, wherein the sheave block unit maintains constant the vertical level of the spreader when the third trolley is moved and the hoisting wire connects the wire driving drum to the spreader through all of the first trolley, the second trolley and the third trolley.

17. The multi-stage trolley claim 16, wherein the sheave block unit includes direction restoring sheave blocks provided on the second trolley, at least one of the direction restoring sheave blocks changing a direction of the hoisting wire provided thereto in the lateral direction into the longitudinal direction to connect the hoisting wire to the third trolley.

18. A crane comprising a multi-stage trolley of claim 17.

19. A crane comprising a multi-stage trolley of claim 16.

20. A crane comprising a multi-stage trolley of claim 13.

* * * * *